US010350896B2

(12) United States Patent
Ishizawa et al.

(10) Patent No.: US 10,350,896 B2
(45) Date of Patent: Jul. 16, 2019

(54) INK REPLENISHMENT CONTAINER

(71) Applicant: SEIKO EPSON CORPORATION, Tokyo (JP)

(72) Inventors: Taku Ishizawa, Matsumoto (JP); Takumi Nagashima, Matsumoto (JP); Tadahiro Mizutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/909,514

(22) Filed: Mar. 1, 2018

(65) Prior Publication Data

US 2018/0250944 A1 Sep. 6, 2018

(30) Foreign Application Priority Data

Mar. 2, 2017 (JP) ..... 2017-039147

(51) Int. Cl.

| | |
|---|---|
| ***B41J 2/175*** | (2006.01) |
| ***B67D 3/02*** | (2006.01) |
| ***B65D 1/02*** | (2006.01) |
| ***B65D 47/24*** | (2006.01) |
| ***B41J 29/13*** | (2006.01) |

(52) U.S. Cl.

CPC ..... *B41J 2/17509* (2013.01); *B41J 2/1752* (2013.01); *B41J 2/17523* (2013.01); *B41J 2/17596* (2013.01); *B41J 29/13* (2013.01); *B65D 1/0246* (2013.01); *B65D 47/248* (2013.01); *B67D 3/02* (2013.01)

(58) Field of Classification Search

CPC ..... B41J 2/17596; B41J 2/17523

See application file for complete search history.

(56) References Cited

U.S. PATENT DOCUMENTS

| | | | | |
|---|---|---|---|---|
| 6,470,744 | B1 * | 10/2002 | Usui | B41J 2/17503 73/290 R |
| 9,315,034 | B2 * | 4/2016 | Ono | B41J 2/17503 |
| 9,718,276 | B2 | 8/2017 | Tomoguchi | |
| 2005/0068385 | A1 * | 3/2005 | Nanjo | B41J 2/17513 347/85 |
| 2011/0254905 | A1 * | 10/2011 | Hayashi | B41J 2/175 347/86 |
| 2012/0008882 | A1 * | 1/2012 | Justice | B41J 2/175 383/43 |

(Continued)

FOREIGN PATENT DOCUMENTS

| | | |
|---|---|---|
| JP | 2016-087844 A | 5/2016 |
| JP | 2017-222152 A | 12/2017 |

*Primary Examiner* — Julian D Huffman
(74) *Attorney, Agent, or Firm* — Foley & Lardner LLP

(57) ABSTRACT

The structure of an ink supplying container is improved. The ink supplying container includes a container body that contains ink and an ink outlet formation portion that is mounted on the leading end side of the container body, and forms an ink outlet. The ink outlet formation portion includes a tubular channel portion that forms a supplying channel into which an ink inlet channel member of an ink tank is inserted and an outlet valve unit accommodated in the tubular channel portion. The outlet valve unit is configured such that, (i) in a non-supplying state, the ink outlet is sealed, and (ii) in a supplying state, the supplying channel of an annular channel portion is in communication with an ink inlet channel of the ink inlet channel member, in the tubular channel portion.

8 Claims, 15 Drawing Sheets

(56) References Cited

U.S. PATENT DOCUMENTS

| | | | | |
|---|---|---|---|---|
| 2012/0050423 | A1* | 3/2012 | Ishikawa | B41J 2/175 347/86 |
| 2012/0075390 | A1* | 3/2012 | Park | B41J 2/175 347/85 |
| 2012/0236072 | A1* | 9/2012 | Kikkawa | B41J 2/16523 347/36 |
| 2015/0224779 | A1* | 8/2015 | Okazaki | B41J 2/1752 347/86 |
| 2017/0021635 | A1* | 1/2017 | Kobayashi | B41J 2/17596 |
| 2017/0355191 | A1 | 12/2017 | Mizutani et al. | |
| 2017/0355194 | A1 | 12/2017 | Fukasawa et al. | |
| 2017/0355195 | A1 | 12/2017 | Fukasawa et al. | |
| 2017/0355196 | A1 | 12/2017 | Shinada et al. | |
| 2017/0355197 | A1 | 12/2017 | Kudo et al. | |

* cited by examiner

INK REPLENISHMENT CONTAINER

CROSS REFERENCE TO RELATED APPLICATION

This application claims priority to Japanese Patent Application No. 2017-039147 filed on Mar. 2, 2017 the entire contents of this application are incorporated by reference herein.

1. Technical Field

The present invention relates to an ink replenishment container for replenishing ink to an ink tank of a printer.

2. Related Art

Inkjet printers are provided with an ink tank for storing ink, and ink is supplied from the ink tank to a printing head. There are two types of ink tanks for such printers, namely, a cartridge type and an ink replenishment type. A cartridge-type ink tank is replaced with a new ink tank when the residual ink amount becomes low. An ink-replenishment-type ink tank is used without being replaced even when the residual ink amount is low, and is refilled with ink from an ink replenishment container.

JP-A-2016-087844 discloses an ink replenishment container used for replenishing ink to an ink-replenishment-type ink tank.

JP-A-2016-087844 is an example of related art.

Incidentally, an ink replenishment container, when it is in use, replenishes ink to an ink tank in an orientation in which its ink outlet is directed downward, and when it is not in use, is kept in an orientation where the ink outlet is directed upward. In this manner, the ink replenishment container often takes on various orientations, and thus securing the sealability of ink is an important issue. In addition, depending on the configuration of the ink replenishment container, not only when it is in use but also when it is being manufactured and is in storage, an issue regarding the sealability of ink and other issues regarding the structure of the ink replenishment container may arise. However, conventionally, ingenuity regarding the structure of an ink replenishment container has not been sufficiently exercised, and there is demand for further improvement.

SUMMARY

The invention has been made in order to solve at least a portion of the above-described issues, and can be realized as the following modes or application example.

(1) According to one mode of the invention, an ink supplying container for supplying ink to an ink tank of a printer through an ink inlet channel member protruding from the ink tank and including an ink inlet channel is provided. This ink supplying container includes a container body that contains the ink and an ink outlet formation portion that is mounted on a leading end side of the container body, and forms an ink outlet. The ink outlet formation portion includes a tubular channel portion that forms a supplying channel into which the ink inlet channel member is inserted and an outlet valve unit that is accommodated in the tubular channel portion. The outlet valve unit is configured such that, (i) in a non-supplying state where the ink inlet channel member is not inserted into the tubular channel portion, the ink outlet is sealed, and, (ii) in a supplying state where the ink inlet channel member is inserted from the ink outlet into the tubular channel portion, the supplying channel is in communication with the ink inlet channel, in the tubular channel portion.

With this ink supplying container, the outlet valve unit is configured such that, in a non-supplying state, the ink outlet is sealed, and, in a supplying state, the supplying channel of the tubular channel portion is in communication with the ink inlet channel of the ink inlet channel member, in the tubular channel portion, and thus it is possible to provide an ink supplying container whose sealing pressure resistance at the ink outlet is high.

(2) In the above ink supplying container, the outlet valve unit may include a spring member that is accommodated in the tubular channel portion, a moving sealing member that is accommodated on a leading end side of the spring member so as to be movable, and is biased by the spring member toward a leading end of the ink supplying container, and an outlet sealing member that is fixed to the ink outlet on a leading end side of the moving sealing member, and has an opening through which the ink inlet channel member passes. The outlet valve unit may be configured such that, (i) in the non-supplying state, the moving sealing member is biased toward the leading end of the ink supplying container by the spring member, and seals the opening of the outlet sealing member, and, (ii) in the supplying state, the moving sealing member is pressed by the ink inlet channel member, and recedes toward the container body, and the supplying channel is in communication with the ink inlet channel, in the tubular channel portion.

With this configuration, the ink outlet can be closed or opened by moving the moving sealing member, and the moving sealing member is biased by the spring member toward the leading end of the ink supplying container, and thus the sealing pressure resistance can be further improved.

(3) In the above ink supplying container, the moving sealing member may include a projection protruding on the leading end side of the moving sealing member, and the outlet valve unit may be configured such that, in the supplying state, a gap is formed in the tubular channel portion between the moving sealing member and the ink inlet channel member due to the projection of the moving sealing member abutting against the ink inlet channel member, and the supplying channel is in communication with the ink inlet channel via the gap.

With this configuration, a gap is formed between the moving sealing member and the ink inlet channel member due to the projection of the moving sealing member, and thus the supplying channel and the ink inlet channel can be brought into communication with each other via this gap.

(4) Regarding the above ink supplying container, the ink inlet channel member may include a partitioning wall that partitions the ink inlet channel into a plurality of ink inlet channels, the projection of the moving sealing member may be included at a position opposing the partitioning wall of the ink inlet channel member, the supplying channel of the tubular channel portion may include a plurality of supplying channels, and the outlet valve unit may be configured such that, in the supplying state, the projection of the moving sealing member abuts against the partitioning wall of the ink inlet channel member, one or more of the plurality of supplying channels are in communication with one or more of the plurality of ink inlet channels, and one or more other supplying channels from among the plurality of supplying channels are in communication with one or more other ink inlet channels from among the plurality of ink inlet channels.

With this configuration, a plurality of supplying channels of the tubular channel portion are in communication with a plurality of ink inlet channels of the ink inlet channel member, and thus the supplying of ink through air-liquid exchange can be performed efficiently.

(5) Regarding the above ink supplying container, the ink inlet channel member may include a partitioning wall that partitions the ink inlet channel into a plurality of ink inlet channels, openings of the plurality of ink inlet channels may be provided on a rear end side relative to a leading end of the partitioning wall, the supplying channel of the tubular channel portion may include a plurality of supplying channels, and the outlet valve unit may be configured such that, in the supplying state, a leading end of the moving sealing member abuts against the leading end of the partitioning wall of the ink inlet channel member, one or more of the plurality of supplying channels are in communication with one or more of the plurality of ink inlet channels, and one or more other supplying channels from among the plurality of supplying channels are in communication with one or more other ink inlet channels from among the plurality of ink inlet channels.

With this configuration, the openings of the plurality of ink inlet channels are provided on the rear end side relative to the leading end of the partitioning wall, and thus, due to the leading end of the moving sealing member abutting against the leading end of the partitioning wall of the ink inlet channel member, a plurality of supplying channels can be brought into communication with a plurality of ink inlet channels of the ink inlet channel member.

(6) Regarding the above ink supplying container, a leading end portion of the ink inlet channel member may include an inclined face in which the openings of the plurality of ink inlet channels are included, and the outlet valve unit may be configured such that, in the supplying state, a gap is formed between the leading end of the moving sealing member and the inclined face of the ink inlet channel member, one or more of the plurality of supplying channels are in communication with one or more of the plurality of ink inlet channels through the gap, and one or more other supplying channels from among the plurality of supplying channels are in communication with one or more other ink inlet channels from among the plurality of ink inlet channels.

With this configuration, the openings of the plurality of ink inlet channels are provided in the inclined face of the ink inlet channel member, and thus a plurality of supplying channels can be brought into communication with a plurality of ink inlet channels via the gap between the leading end of the moving sealing member and the inclined face of the ink inlet channel member.

(7) Regarding the above ink supplying container, the leading end portion of the ink inlet channel member may include an outer peripheral surface on which the openings of the plurality of ink inlet channels are formed, and the outlet valve unit may be configured such that, in the supplying state, openings of one or more of the plurality of ink inlet channels are in communication with one or more of the plurality of supplying channels, in the tubular channel portion, and opening of one or more other ink inlet channels from among the plurality of ink inlet channels are in communication with one or more other supplying channels from among the plurality of supplying channels, in the tubular channel portion.

With this configuration, the openings of a plurality of ink inlet channels are provided in the outer peripheral surface of the ink inlet channel member, and thus the openings of a plurality of ink inlet channels can be brought into communication with a plurality of supplying channels, in the tubular channel portion.

(8) In the above ink supplying container, the outlet sealing member may be formed of a rubber member that deforms so as to contact with the outer peripheral surface of the ink inlet channel member, and seals the outer peripheral surface of the ink inlet channel member, in the supplying state.

With this configuration, it is possible to improve the sealing performance of the outer peripheral surface of the ink inlet channel member in the supplying state.

The invention can be realized as various modes other than the above-described ink supplying container. For example, the invention can be realized as modes such as an ink supplying system that includes an ink tank and an ink supplying container.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
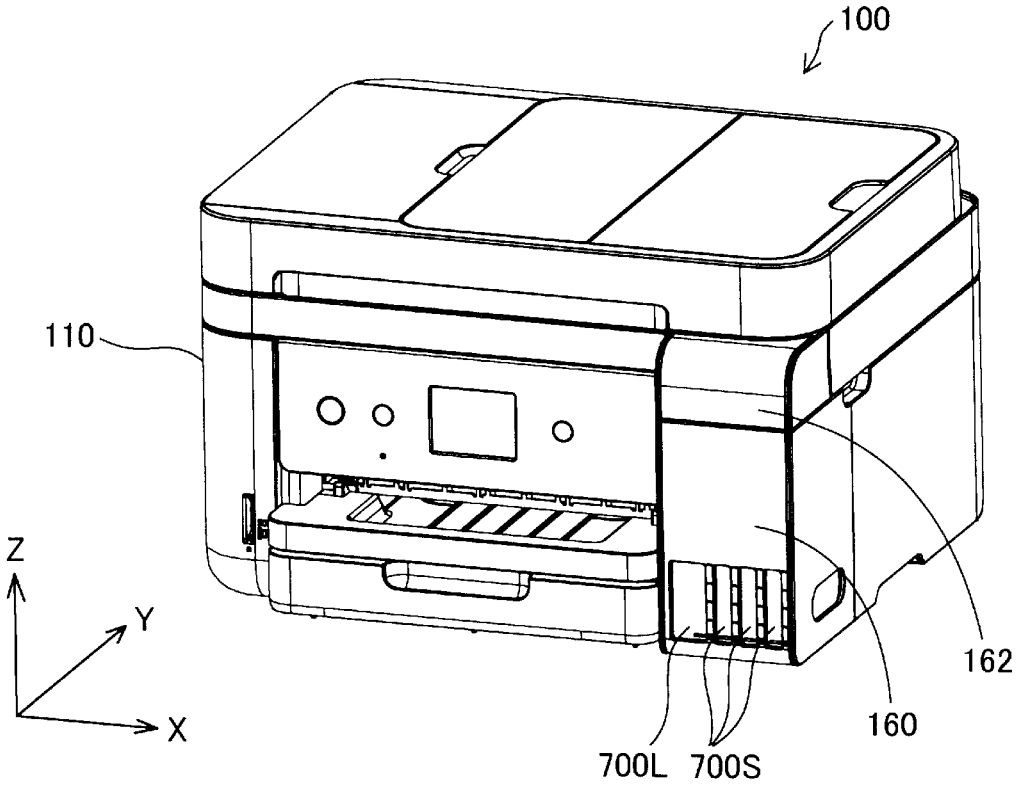
FIG. 1 is a perspective view of a printer of a first embodiment.

FIG. 1 is a perspective view of a printer 100 in a first embodiment. This printer 100 is an inkjet printer that performs printing by discharging ink onto a printing medium. In FIG. 1, X, Y, and Z axes orthogonal to each other are illustrated. The X axis corresponds to the width direction of the printer 100, the Y axis corresponds to the depth direction of the printer 100, and the Z axis corresponds to the height direction of the printer 100. The printer 100 is installed on a horizontal installation surface defined by an X direction and a Y direction.

The printer 100 has a case 110. A carriage (not illustrated) that can move in a main scanning direction (the X direction) is provided inside the case 110. A printing head for discharging ink onto a printing medium is installed in the carriage. An ink tank housing unit 160 that houses a plurality of ink tanks 700S and 700L is provided at one end of the front face of the case 110. The ink tank housing unit 160 has a lid 162 thereon, which can be opened/closed. Note that an ink tank 700S is a tank having a small capacity, and an ink tank 700L is a tank having a large capacity. However, in the following description, the ink tanks 700S and 700L are simply referred to as "ink tanks 700" without being distinguished from each other. The ink tanks 700 are connected to the printing head of the carriage via tubes (not illustrated). Accordingly, the ink tanks 700 are stationary ink tanks that are not placed on the carriage of the printer 100. In addition, the ink tanks 700 are ink-replenishment (supplying)-type ink tanks that are refilled with ink from an ink replenishment (supplying) container when the residual ink amount becomes low.

Figure 2:
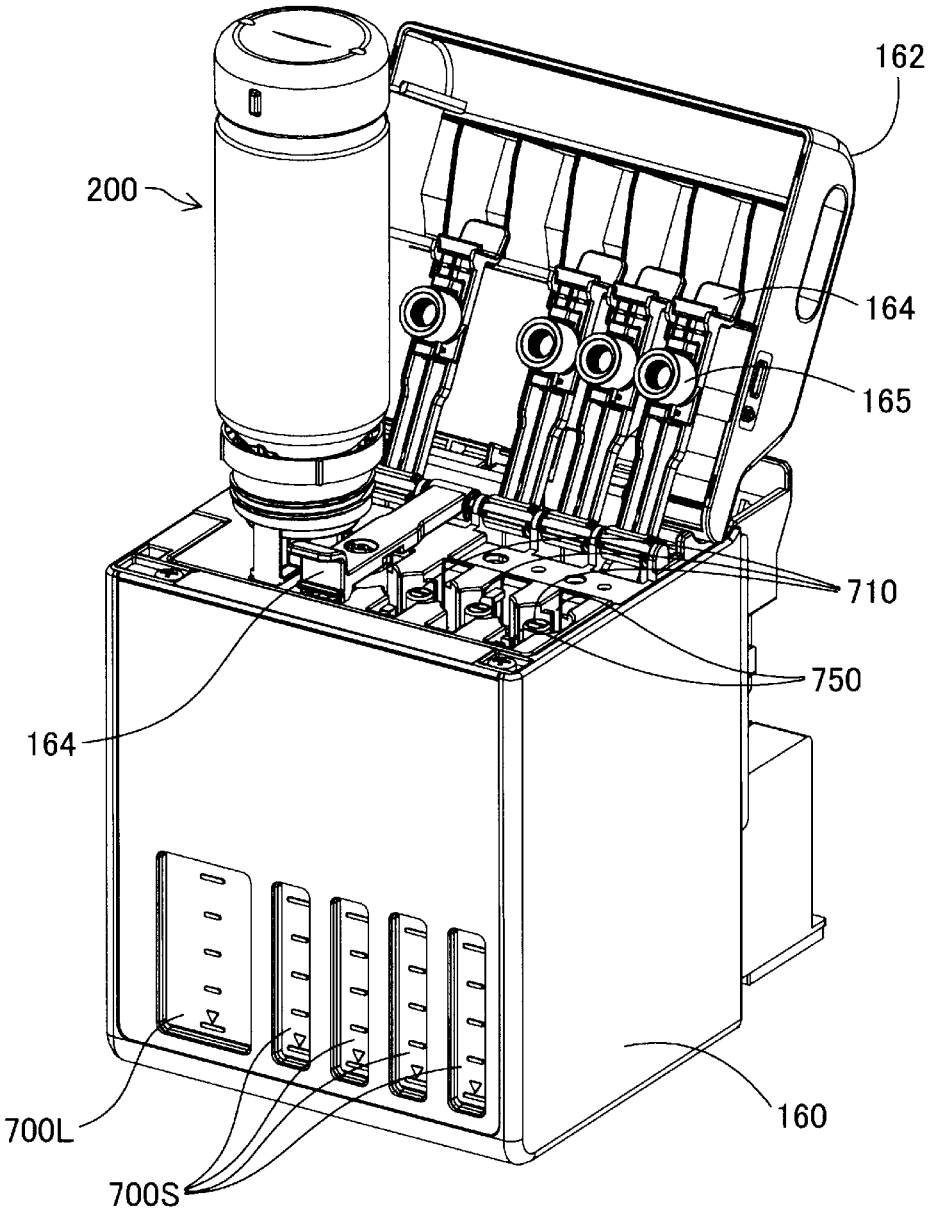
FIG. 2 is a perspective view showing a state where an ink replenishment container is inserted into an ink tank.

FIG. 2 is a perspective view showing a state where an ink replenishment (supplying) container 200 is used to replenish ink to one of the ink tanks 700. The front faces of the ink tanks 700 are formed of a transparent member, and the residual ink amounts of the ink tanks 700 are visible from the outside. As shown in FIG. 2, it is possible to open the lid 162 and replenish ink from an ink inlet channel member 710 of an ink tank 700 when the residual ink amount is low.

In the upper face of each of the ink tanks 700, a cylindrical ink inlet channel member 710 for replenishing ink to the ink tank 700 is provided. The ink tank housing unit 160 has cap members 164 that each include a cap 165 for sealing the leading end of the ink inlet channel member 710. In a state where ink is not replenished to the ink tank 700, the leading end of each of the ink inlet channel members 710 is sealed by a cap 165 of the cap member 164. When replenishing ink to the ink tank 700, the cap member 164 is removed from the ink inlet channel member 710, the leading end portion of the ink replenishment container 200 is inserted at the position of the ink inlet channel member 710, and ink is replenished. Two recessed portions 750 in which fitting portions (to be described later) of the ink replenishment container 200 are fitted are provided in the periphery of the ink inlet channel member 710. These recessed portions 750 have shapes that are 180-degree rotationally symmetrical relative to the ink inlet channel member 710.

In this specification, the term "replenishment of ink" refers to an operation of supplying ink to the ink tank 700 so as to increase the residual ink amount. However, the ink tank 700 does not need to be completely filled with ink through "replenishment of ink". In addition, "replenishment of ink" also includes an operation of filling the empty ink tank 700 with ink when the printer 100 is used for the first time.

Figure 3:
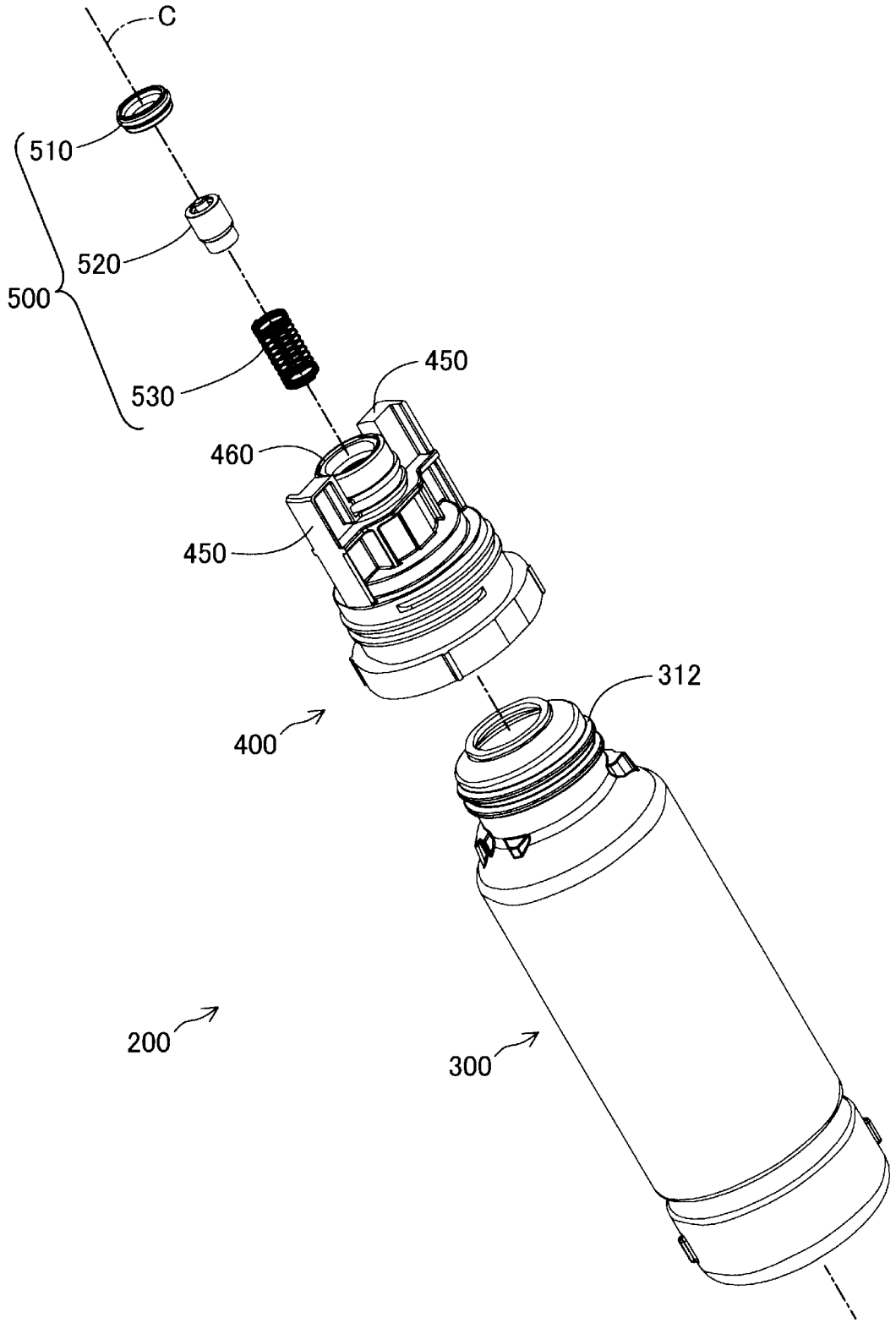
FIG. 3 is an exploded perspective view of an ink replenishment container of the first embodiment.

FIG. 3 is an exploded perspective view of the ink replenishment container 200 in the first embodiment. The ink replenishment container 200 has a container body 300 that can store ink, an ink outlet formation portion 400 that forms an ink outlet 460, and an outlet valve unit 500. The ink replenishment container 200 further has a cap (not illustrated) that is mounted on the top side of the ink outlet formation portion 400. The container body 300 is a hollow cylindrical container that has an opening on the leading end side. An external screw 312 for mounting the ink outlet formation portion 400 is provided in a smaller diameter portion that is at the leading end of the container body 300. The ink outlet 460 is provided at the leading end of the ink outlet formation portion 400. The outlet valve unit 500 is mounted to the ink outlet 460. Therefore, the outlet valve unit 500 can be regarded as a member constituting a portion of the ink outlet formation portion 400. When replenishing ink to the ink tank 700, the ink inlet channel member 710 (FIG. 2) of the ink tank 700 is inserted into the ink outlet 460.

The outlet valve unit 500 has an outlet sealing member 510, a moving sealing member 520, and a spring member 530. The outlet sealing member 510 is a rubber member that has a substantially ring-like shape. The moving sealing member 520 is a member that has a substantially cylindrical shape. The outlet sealing member 510 has the function of a valve seat, and the moving sealing member 520 has the function of a valve body. The spring member 530 is a coil spring. The outlet valve unit 500 is configured to, in a non-replenishment state where ink is not replenished to the ink tank 700, seal the ink outlet 460 such that ink does not leak to the outside, and in a replenishment state where ink is replenished to the ink tank 700, release the sealing such that ink flows into the ink inlet channel member 710. Operations of the outlet valve unit 500 in a non-replenishment state and a replenishment state will be described later.

Two fitting portions 450 are provided in the periphery of the ink outlet 460. These fitting portions 450 are positioning members that position the ink replenishment container 200 by being fitted in the recessed portions 750 (FIG. 2) provided in the periphery of the ink inlet channel member 710 of the ink tank 700. In the first embodiment, the two fitting portions 450 have shapes that are 180-degree rotationally symmetrical relative to the central axis C of the ink replenishment container 200. Similarly, the recessed portions 750 provided in the periphery of the ink inlet channel member 710 of the ink tank 700 also have shapes that are 180-degree rotationally symmetrical relative to the ink inlet channel member 710. When replenishing ink, the direction of the ink replenishment container 200 is restricted to two 180-degree rotationally symmetrical directions by fitting the fitting portions 450 of the ink replenishment container 200 in the recessed portions 750 in the periphery of the ink inlet channel member 710 of the ink tank 700. As a result, during ink replenishment, the ink replenishment container 200 can be kept in a stable orientation. Note that the fitting portions 450 can be omitted.

Note that in this specification, a direction parallel to the central axis C of the ink replenishment container 200 is referred to as an "axis direction", and a direction outward from the central axis C is referred to as a "diameter direction".

Figure 4:
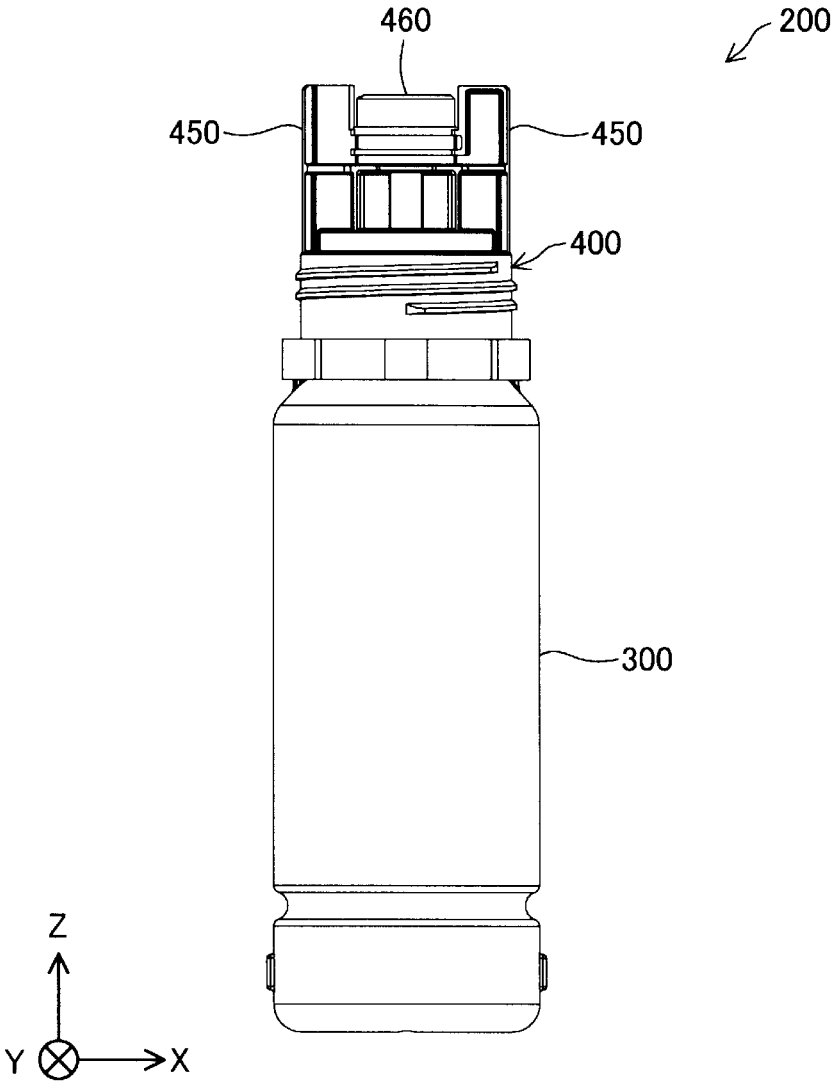
FIG. 4 is a front view of the ink replenishment container of the first embodiment.
Figure 5:
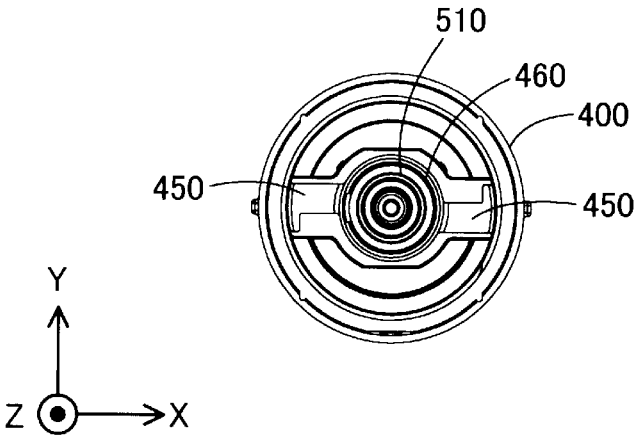
FIG. 5 is a plan view of the ink replenishment container of the first embodiment.

FIG. 4 is a front view of the ink replenishment container 200 in a normally placed state, and FIG. 5 is a plan view of the ink replenishment container 200 in a normally placed state. The "normally placed state of the ink replenishment container 200" refers to a state where the ink replenishment container 200 is placed on a horizontal surface such as a desk with the bottom portion of the container body 300 being directed downward. The upper end side of the ink replenishment container 200 in this normally placed state is referred to as a "leading end side", and the lower end side is referred to as a "rear end side". A+Z direction in the drawings of FIG. 4 onward indicates the vertically upward direction of the ink replenishment container 200 in the normally placed state. As shown in FIG. 2 above, replenishment of ink to the ink tank 700 is performed in an inverted orientation in which the leading end side of the ink replenishment container 200 is directed downward. Note that FIGS. 4 and 5 show a state where a cap (not illustrated) is removed.

Figure 6:
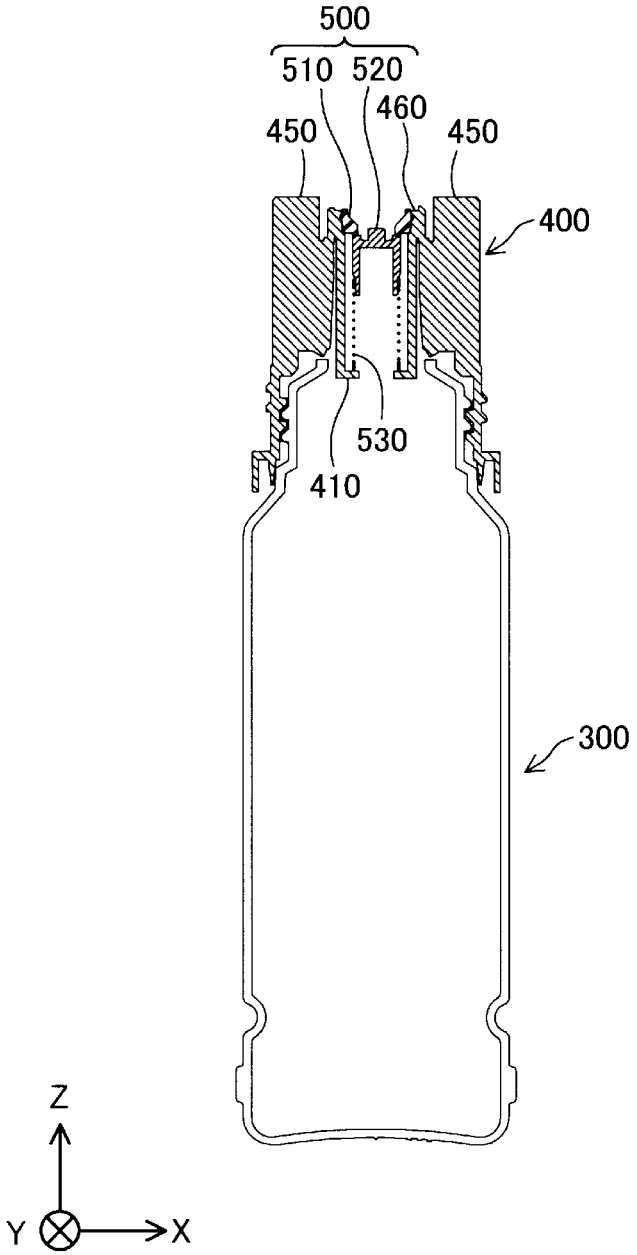
FIG. 6 is a longitudinal cross-sectional view of the ink replenishment container of the first embodiment.

FIG. 6 is a longitudinal cross-sectional view of the ink replenishment container 200. As described with reference to FIG. 3, the ink outlet 460 is provided between the two fitting portions 450 of the ink outlet formation portion 400. The ink outlet 460 has a tubular channel portion 410 that forms a replenishment channel into which the ink inlet channel member 710 can be inserted. The outlet sealing member 510, the moving sealing member 520, and the spring member 530 of the outlet valve unit 500 are accommodated in the tubular channel portion 410. The spring member 530 is accommodated furthest on the rear end side in the tubular channel portion 410. The moving sealing member 520 is accommodated on the leading end side of the spring member 530 in the tubular channel portion 410 so as to be movable, and is biased toward the leading end by the spring member 530. The outlet sealing member 510 is fixed to the ink outlet 460. The outlet sealing member 510 has an opening through which the ink inlet channel member 710 can pass. FIG. 6 shows a cross section in the non-replenishment state where ink is not replenished to the ink tank 700. In this non-replenishment state, the outlet valve unit 500 seals the ink outlet 460. Note that, in the outlet valve unit 500 of the first embodiment, the moving sealing member 520 is biased toward the leading end by the spring member 530, and thus it is possible to acquire high sealing pressure resistance compared to another type of valve such as a slit valve, for example. Specifically, in a non-replenishment state, even in a case where the ink replenishment container 200 is brought into the inverted orientation, the possibility that ink will leak out from the ink outlet 460 can be reduced.

Figure 7:
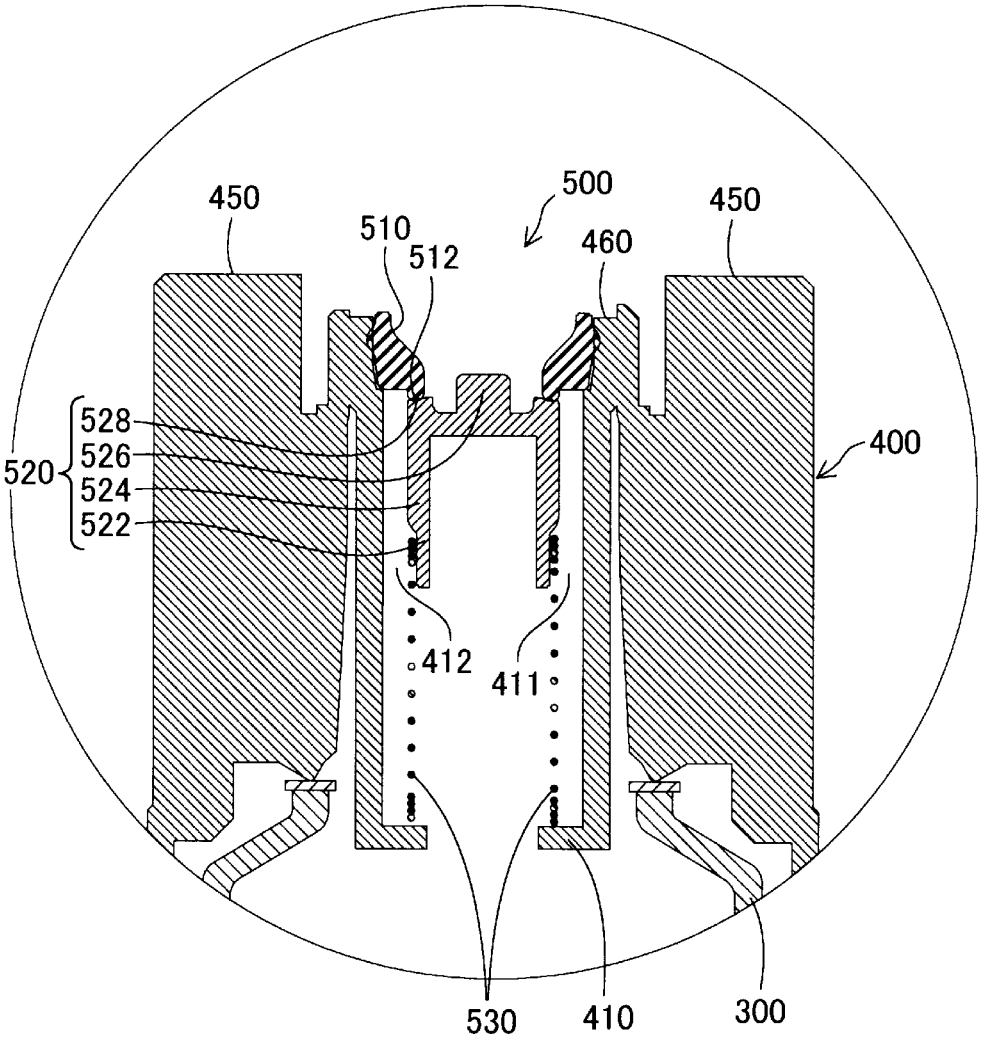
FIG. 7 is an enlarged view of a portion of FIG. 6.

FIG. 7 is an enlarged view of a portion of FIG. 6. In the first embodiment, the moving sealing member 520 has a projection 526 protruding on the leading end side. An annular abutting portion 528 is formed in the periphery of the projection 526. In the non-replenishment state shown in FIG. 7, this annular abutting portion 528 abuts against an annular protrusion 512 at the rear end of the outlet sealing member 510, and seals the opening of the outlet sealing member 510. The projection 526 protrudes on the leading end side relative to this annular abutting portion 528. On the rear end side of the moving sealing member 520, a cylindrical portion 524 and a spring engagement portion 522 are provided on rear end side of the cylindrical portion 524. The spring engagement portion 522 has an external diameter that is smaller than the cylindrical portion 524. The leading end portion of the spring member 530 is locked to the outer periphery of the spring engagement portion 522.

A channel in the tubular channel portion 410 (also referred to as a "replenishment channel") is sectioned into two replenishment channels 411 and 412. As will be described later, in a replenishment state of ink, one of the two replenishment channels 411 and 412 is used as a channel for ink, and the other is used as a channel for air. As a result, it is possible to replenish ink from the ink replenishment container 200 to the ink tank 700 while performing air-liquid exchange therebetween. When replenishing ink through air-liquid exchange, the container body 300 does not need to be squeezed. The type of ink replenishment container that makes it possible to replenish ink without squeezing the container body 300 in this manner is also referred to as a "non-compression type". Note that the channel in the tubular channel portion 410 does not need to be sectioned into the two replenishment channels 411 and 412, and may be formed as a single replenishment channel. In addition, the channel in the tubular channel portion 410 may be sectioned into three or more replenishment channels.

The outlet sealing member 510 can be a rubber member (elastomer) that has rubber elasticity, for example. The moving sealing member 520 can be made of a thermoplastic resin such as polyethylene or polypropylene. The spring member 530 can be made of metal, for example. The constituent elements of the ink replenishment container 200 other than the outlet valve unit 500 can be made of a thermoplastic resin such as polyethylene or polypropylene.

During shipment of the ink replenishment container 200 as a product, the ink outlet 460 may be sealed by a film. This sealing film can also be used as a fixing member that fixes the outlet sealing member 510 to the ink outlet 460. Note that the space between the outlet sealing member 510 and the moving sealing member 520 is sealed in a state where the moving sealing member 520 is biased by the spring member 530, and thus the film itself that seals the ink outlet 460 is not required to have the function of sealing ink. Therefore, for example, a configuration may be adopted in which a cut is provided in the film such that the ink inlet channel member 710 of the ink tank 700 can easily tear the film. Note that the outlet sealing member 510 may be fixed to the ink outlet 460 using another fixing means such as heat caulking a resin member that forms the ink outlet 460, in place of the sealing film.

Figure 8:
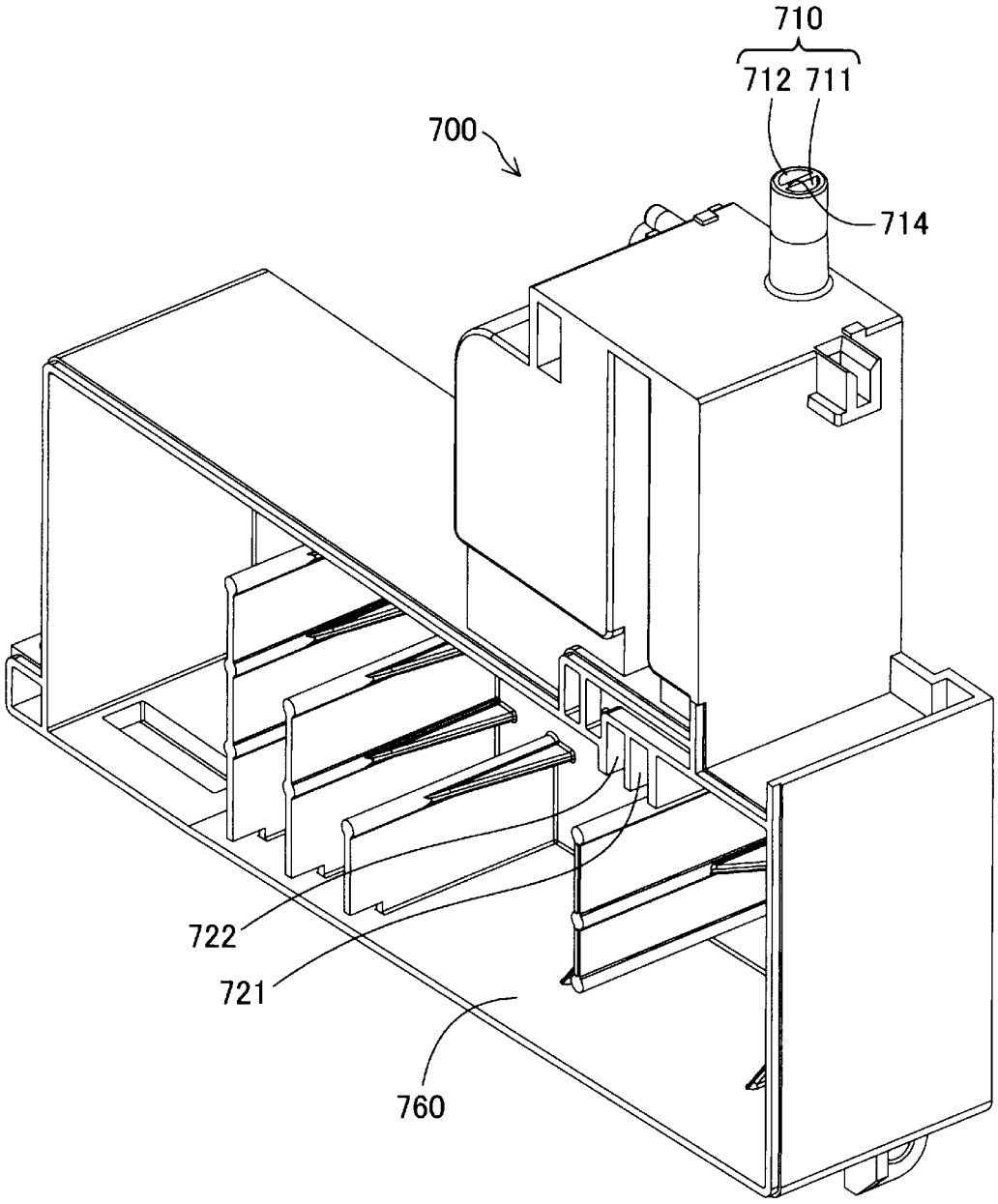
FIG. 8 is a perspective view of an ink tank of the first embodiment.

FIG. 8 is a perspective view of the ink tank 700 of the first embodiment. The ink inlet channel member 710 of the ink tank 700 protrudes upward from the ink tank 700. The ink inlet channel member 710 has two ink inlet channels 711 and 712. The two ink inlet channels 711 and 712 are sectioned by a partitioning wall 714. In the first embodiment, the leading end face of the ink inlet channel member 710 is flat, and the two ink inlet channels 711 and 712 are open in the leading end face of the ink inlet channel member 710. In addition, a portion of the leading end face of the ink inlet channel member 710 corresponds to the edge portion of the partitioning wall 714. When replenishing ink, the fitting portions 450 of the ink replenishment container 200 are fitted into the recessed portions 750 in the periphery of the ink inlet channel member 710 of the ink tank 700, and positioning of the ink replenishment container 200 in the circumferential direction is performed. Accordingly, the two ink inlet channels 711 and 712 are respectively in communication with two channels 721 and 722 in-the-tank protruding into an ink housing chamber 760 that is positioned in a lower portion of the ink tank 700. The lower ends of these channels 721 and 722 extend to a position lower than the ceiling wall of the ink housing chamber 760, in the tank. This is because, when replenishing ink from the ink replenishment container 200 to the ink tank 700, air-liquid exchange stops when the liquid level in the ink housing chamber 760 reaches the lower ends of the channels 721 and 722 in-the-tank, and accordingly replenishment of ink also stops, thus making the ink replenishing operation easy.

The two ink inlet channels 711 and 712 of the ink inlet channel member 710 respectively correspond to the two replenishment channels 411 and 412 of the tubular channel portion 410 of the ink replenishment container 200 shown in FIG. 7. Note that as described above, in a replenishment state, any of the two 180-degree rotationally symmetrical directions can be adopted as the direction of the ink replenishment container 200. Therefore, in a replenishment state, by fitting the fitting portions 450 of the ink replenishment container 200 into the recessed portions 750 in the periphery of the ink inlet channel member 710 of the ink tank 700, the direction of the ink replenishment container 200 is restricted to the two 180-degree rotationally symmetrical directions, and one of the replenishment channels 411 and 412 is in communication with one of the ink inlet channels 711 and 712, and the other of the replenishment channels 411 and 412 is in communication with the other of the ink inlet channels 711 and 712. However, the ink inlet channel of the ink inlet channel member 710 does not need to be sectioned into the two ink inlet channels 711 and 712, and may be formed as a single channel. In addition, the ink inlet channel of the ink inlet channel member 710 may be sectioned into three or more ink inlet channels. Note that, if the ink inlet channel of the ink inlet channel member 710 is sectioned into a plurality of ink inlet channels, there is an advantage that ink can be efficiently replenished through air-liquid exchange.

Figure 9:
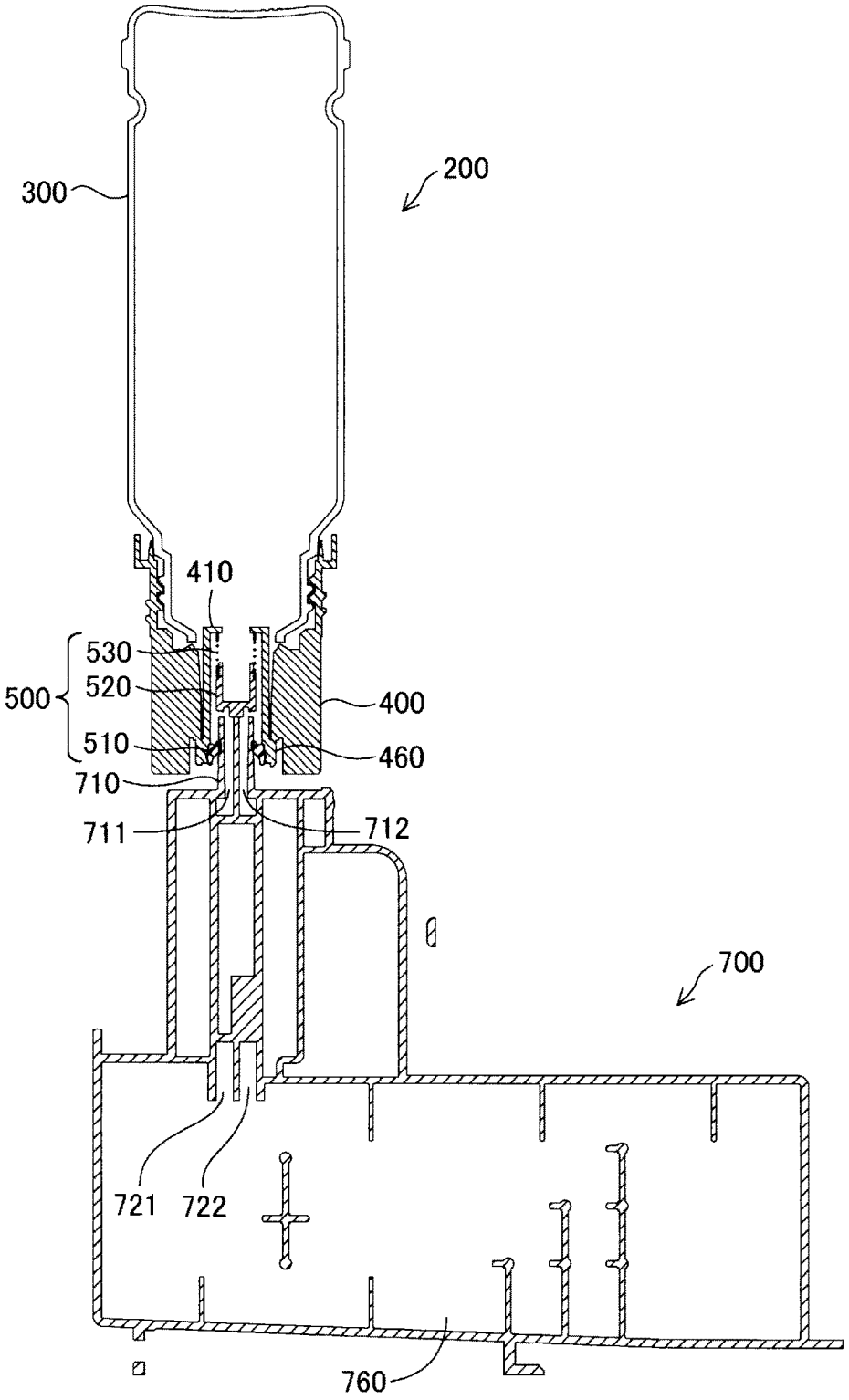
FIG. 9 is a cross-sectional view showing a replenishment state in the first embodiment.

FIG. 9 is a cross-sectional view showing a replenishment state where ink is replenished from the ink replenishment container 200 to the ink tank 700. In this replenishment state, the ink replenishment container 200 is in an inverted orientation. In addition, the ink inlet channel member 710 of the ink tank 700 is inserted into the tubular channel portion 410 via the opening of the outlet sealing member 510. The outlet valve unit 500 is configured such that, in this replenishment state, the replenishment channels 411 and 412 (FIG. 7) in the tubular channel portion 410 are in communication with the ink inlet channels 711 and 712 of the ink inlet channel member 710.

Figure 10:
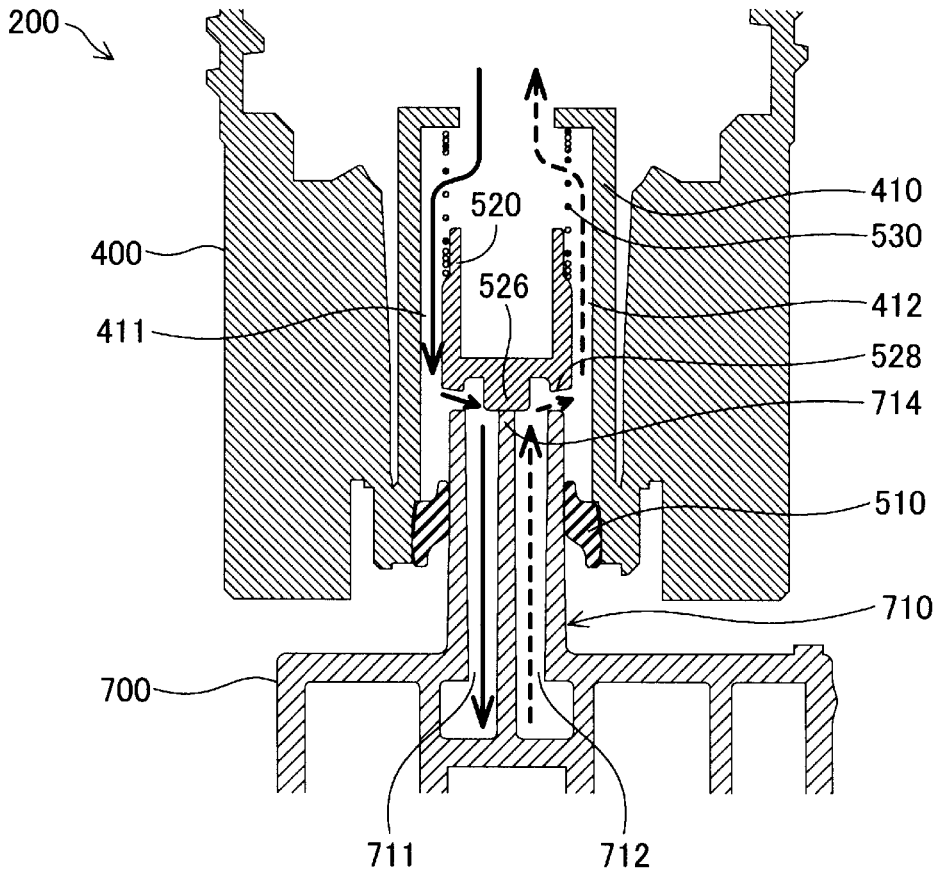
FIG. 10 is an enlarged view of a portion of FIG. 9.

FIG. 10 is an enlarged view of a portion of FIG. 9. However, the container body 300 is not illustrated. The projection 526 of the moving sealing member 520 is provided at a position opposing the partitioning wall 714 of the ink inlet channel member 710. In a replenishment state, the projection 526 of the moving sealing member 520 is pressed by the ink inlet channel member 710, and recedes toward the container body 300, and the ink inlet channels 711 and 712 of the ink inlet channel member 710 are respectively brought into communication with the replenishment channels 411 and 412 in the tubular channel portion 410. As a result, ink in the container body 300 is allowed to flow into the ink inlet channel member 710 via the replenishment channel 411 or 412. In FIG. 10, solid line arrows indicate the flow of ink, and broken line arrows indicate the flow of air. In this manner, in a replenishment state, it is possible to efficiently replenish ink from the ink replenishment container 200 to the ink tank 700 while performing air-liquid exchange using the two ink inlet channels 711 and 712 of the ink inlet channel member 710 and the two replenishment channels 411 and 412 in the tubular channel portion 410. In order to smoothly perform this air-liquid exchange, the replenishment channel in the tubular channel portion 410 is preferably sectioned into a plurality of replenishment channels. The same applies to the ink inlet channel in the ink inlet channel member 710. In this case, a configuration is preferably adopted in which, in a replenishment state, one or more of the plurality of replenishment channels are in communication with one or more of the plurality of ink inlet channels, and one or more of the other replenishment channels from among the plurality of replenishment channels are in communication with one or more of the other ink inlet channels from among the plurality of ink inlet channels.

Note that in the first embodiment, a configuration is adopted in which, in a replenishment state, a gap is formed between the moving sealing member 520 and the ink inlet channel member 710 due to the projection 526 of the moving sealing member 520 abutting against the ink inlet channel member 710, and the replenishment channels 411 and 412 of the tubular channel portion 410 are brought into communication with the ink inlet channels 711 and 712 of the ink inlet channel member 710 via this gap. In this manner, if a gap is formed between the moving sealing member 520 and the ink inlet channel member 710 by providing the projection 526 at the leading end of the moving sealing member 520 and the projection 526 then abutting against the ink inlet channel member 710, a communication state between the channels can be easily realized.

In addition, in the replenishment state shown in FIG. 10, the outlet sealing member 510 is in contact with the outer peripheral surface of the ink inlet channel member 710 so as to seal the outer peripheral surface of the ink inlet channel member 710. With this configuration, it is possible to prevent the leakage of ink to the outside, and improve the sealing performance of the outer peripheral surface of the ink inlet channel member 710.

Figure 11:
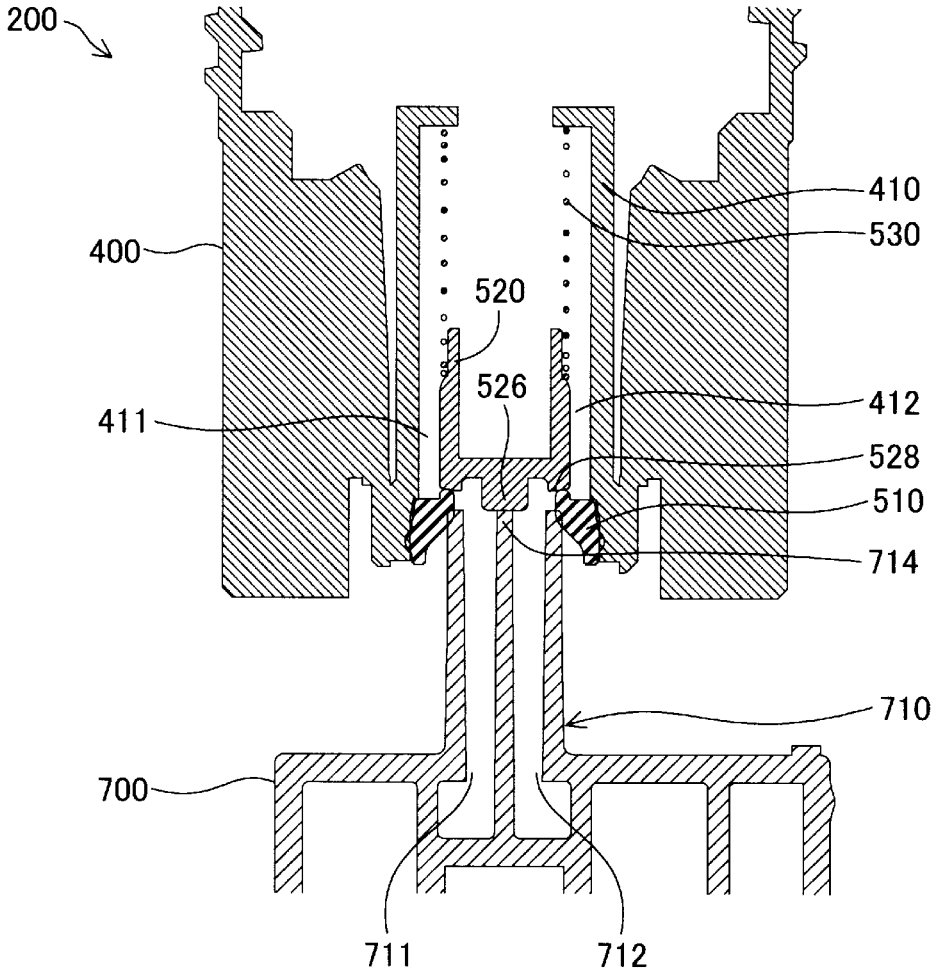
FIG. 11 is a cross-sectional view of a non-replenishment state immediately before the replenishment state shown in FIG. 10.

FIG. 11 shows a non-replenishment state immediately before the replenishment state shown in FIG. 10. This state is a state where the leading end portion of the ink replenishment container 200 is lowered toward the ink tank 700, and the leading end of the ink inlet channel member 710 is in contact with the projection 526 of the moving sealing member 520. At this time, the moving sealing member 520 and the outlet sealing member 510 remain sealed therebetween. In addition, in FIG. 11, sealing between the outlet sealing member 510 and the outer peripheral surface of the ink inlet channel member 710 has started. If the outlet valve unit 500 is configured such that, in this manner, sealing between the outer peripheral surface of the ink inlet channel member 710 and the outlet sealing member 510 is started in a state immediately before a replenishment state is reached, it is possible to further reduce the possibility that ink will leak to the outside during a period in which the ink replenishment container 200 is then further lowered until the replenishment state shown in FIG. 10 is reached.

As described above, in the first embodiment, a configuration is adopted in which the outlet valve unit 500 seals the ink outlet 460 in a non-replenishment state where the replenishment of ink to the ink tank 700 is not performed. On the other hand, a configuration is adopted in which, in a replenishment state where the replenishment of ink to the ink tank 700 is performed, the replenishment channels 411 and 412 are in communication with the ink inlet channels 711 and 712 of the ink inlet channel member 710, in the tubular channel portion 410. Therefore, it is possible to provide an ink replenishment container 200 in which the sealing pressure resistance in the ink outlet 460 is high.

Second Embodiment

Figure 12:
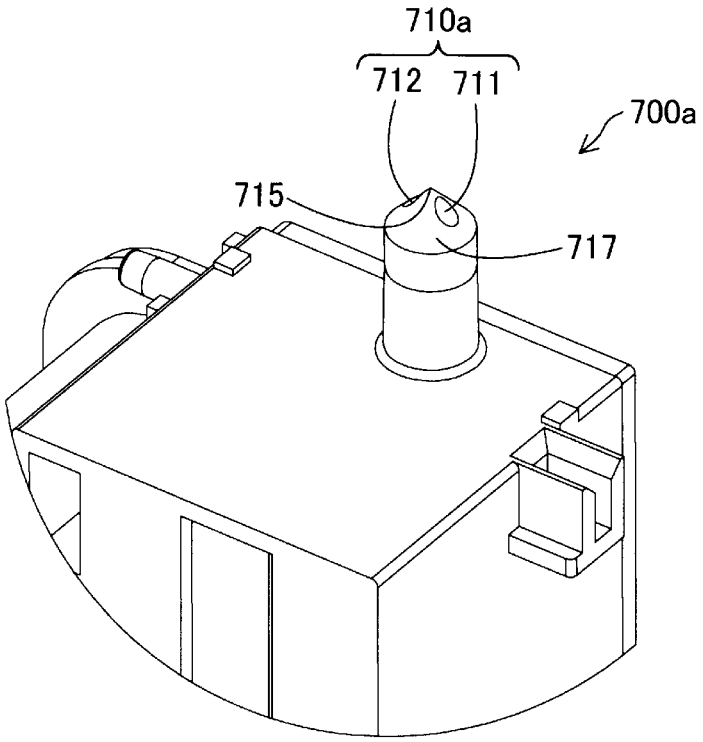
FIG. 12 is a perspective view showing an ink tank of a second embodiment.

FIG. 12 is a perspective view showing an ink tank **700*a* that has an ink inlet channel member 710*a* of a second embodiment, and is a diagram corresponding to FIG. 8 of the first embodiment. The leading end portion of the ink inlet channel member 710*a* of the second embodiment is formed in a shape having a peak portion 715 and an inclined face 717 that has the openings of two ink inlet channels 711 and 712. The inclined face 717 is inclined from the peak portion 715 toward the rear end side of the ink inlet channel member 710*a***.

Figure 13:
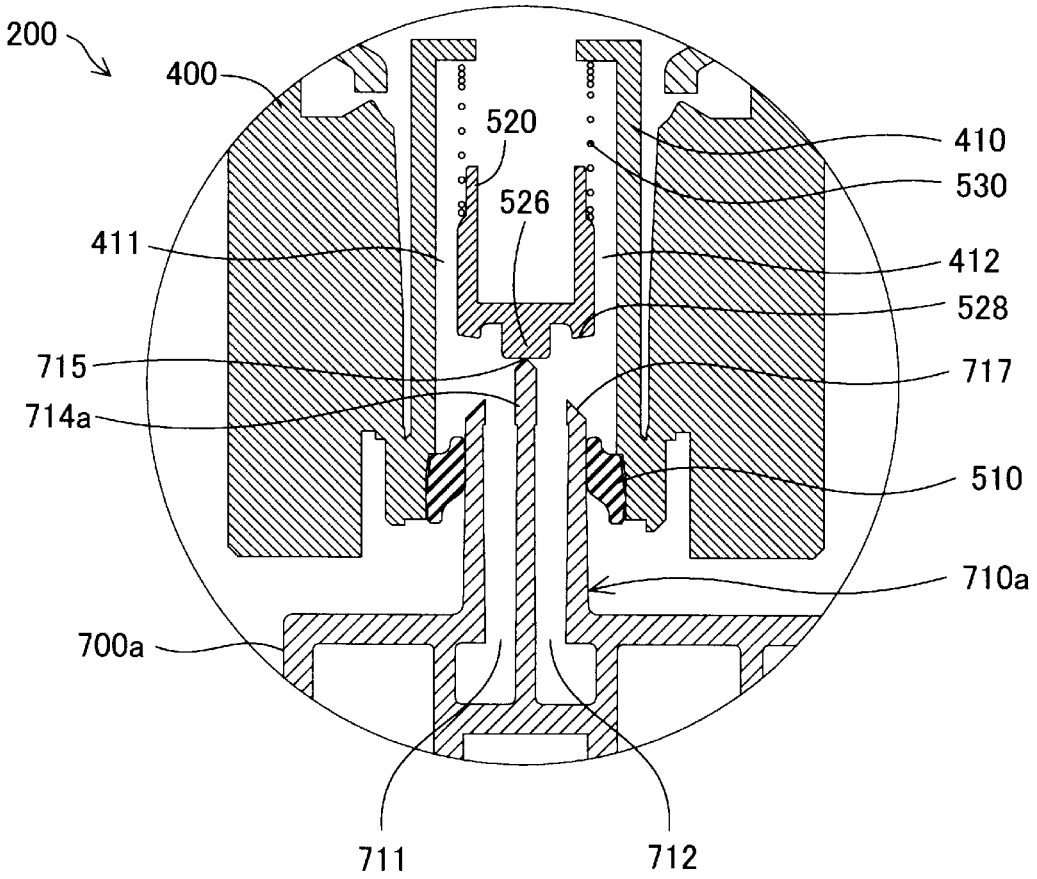
FIG. 13 is a cross-sectional view showing a replenishment state in the second embodiment.

FIG. 13 is a cross-sectional view showing a replenishment state for the ink tank **700*a* of the second embodiment shown in FIG. 12, and is a diagram corresponding to FIG. 9 of the first embodiment. The ink outlet formation portion 400 has the same structure as that of the first embodiment. The peak portion 715 of the ink inlet channel member 710*a* of the second embodiment is a portion corresponding to the leading end of a partitioning wall 714*a* that partitions the two ink inlet channels 711 and 712. In this replenishment state, an outlet valve unit 500 is configured such that the leading end of a projection 526 of a moving sealing member 520 abuts against the peak portion 715** of the ink inlet channel member 710*a*. In addition, at this time, a gap is formed between the inclined face 717 of the ink inlet channel member 710*a* and an annular abutting portion 528 of the moving sealing member 520, and a plurality of replenishment channels 411 and 412 of a tubular channel portion 410 are brought into communication with the ink inlet channels 711 and 712 of the ink inlet channel member 710*a* via this gap. Therefore, also according to this second embodiment, an effect similar to that of the first embodiment can be achieved.

Third Embodiment

Figure 14:
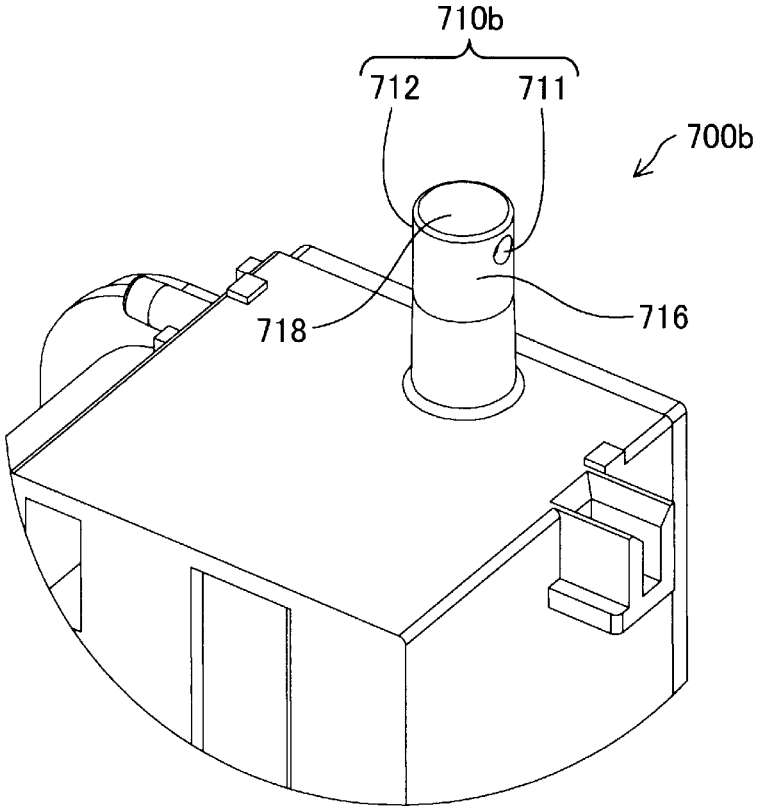
FIG. 14 is a perspective view showing an ink tank of a third embodiment.

FIG. 14 is a perspective view showing an ink tank 700*b* having an ink inlet channel member 710*b* of a third embodiment. At the leading end portion of the ink inlet channel member 710*b* of the third embodiment, the openings of two ink inlet channels 711 and 712 are not formed in a leading end face 718 of the ink inlet channel member 710*b*, and are formed in an outer peripheral surface 716 of the ink inlet channel member 710*b*.

Figure 15:
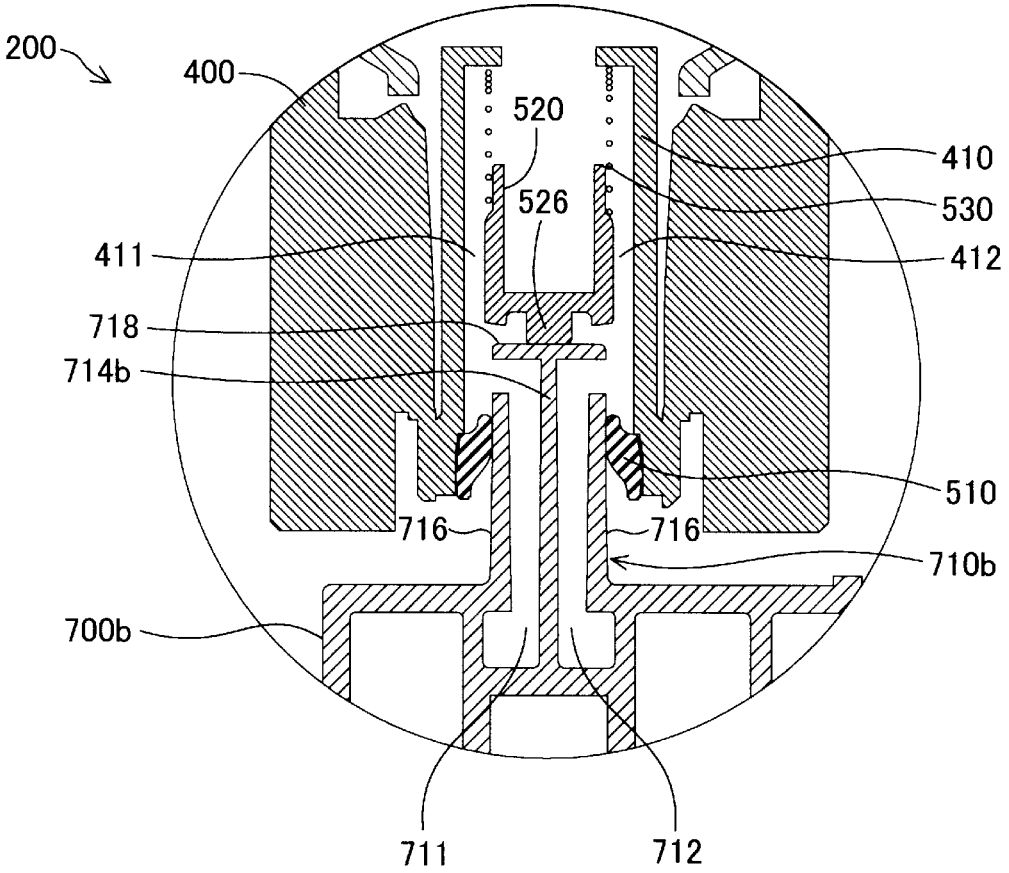
FIG. 15 is a cross-sectional view showing a replenishment state in the third embodiment.

FIG. 15 is a cross-sectional view showing a replenishment state for the ink tank 700*b* of the third embodiment shown in FIG. 14. The ink outlet formation portion 400 has the same structure as that of the first embodiment. The leading end face 718 of the ink inlet channel member 710*b* of the third embodiment is a portion corresponding to the leading end of a partitioning wall 714*b* that partitions the two ink inlet channels 711 and 712. In this replenishment state, the ink outlet formation portion 400 is configured such that a projection 526 at the top of a moving sealing member 520 abuts against the leading end face 718 of the ink inlet channel member 710*b*. The two ink inlet channels 711 and 712 of the ink inlet channel member 710*b* are open in the outer peripheral surface 716 of the ink inlet channel member 710*b*, and thus replenishment channels 411 and 412 of a tubular channel portion 410 are in communication with the ink inlet channels 711 and 712 of the ink inlet channel member 710*a* via these openings. Therefore, also in this third embodiment, an effect similar to that of the first embodiment can be acquired.

The above second and third embodiments are the same in that the openings of the ink inlet channels 711 and 712 of the ink inlet channel member 710 are provided on the rear end side relative to the leading end of the partitioning wall 714. If such a structure is adopted, in a replenishment state, due to the leading end of the moving sealing member 520 abutting against the leading end of the partitioning wall 714 of the ink inlet channel member 710, in the tubular channel portion 410, the replenishment channels 411 and 412 of the tubular channel portion 410 can be respectively brought into communication with the ink inlet channels 711 and 712 of the ink inlet channel member 710.

Note that, in the second embodiment shown in FIG. 13, it is also possible to adopt a structure in which the projection 526 is not formed at the leading end of the moving sealing member 520. Also in this structure, a gap is formed between the leading end of the moving sealing member 520 and the inclined face 717 of the ink inlet channel member 710*a*, and thus the replenishment channels 411 and 412 of the tubular channel portion 410 can be brought into communication with the ink inlet channels 711 and 712 of the ink inlet channel member 710*a* via that gap. Therefore, the projection 526 of the moving sealing member 520 can be omitted. Similarly, also in the third embodiment, the projection 526 of the moving sealing member 520 can be omitted.

MODIFIED EXAMPLES

The invention is not limited to the aforementioned embodiments and Modified Examples thereof, and can be achieved as various aspects without departing from the gist of the invention.

Modified Example 1

Some of the constituent members of the ink replenishment container 200 of the above embodiments can be suitably omitted and changed. For example, a cap may be omitted. Also, a portion or the entirety of the container body 300 may be configured using a flexible bag body. In addition, a specific structure of the outlet valve unit 500 can be changed as appropriate. However, the outlet valve unit 500 is preferably configured such that the ink outlet 460 is sealed in a non-replenishment state where the ink inlet channel member 710 is not inserted into the tubular channel portion 410, and the replenishment channels of the tubular channel portion 410 are in communication with the ink inlet channels of the ink inlet channel member 710, in the tubular channel portion 410, in a replenishment state where the ink inlet channel member 710 is inserted from the ink outlet 460 into the tubular channel portion 410.

Modified Example 2

In the above embodiments, a non-compression-type ink replenishment container was described, but the invention can be applied to a compression-type ink replenishment container. In addition, the invention is not limited to an ink storing container such as an ink replenishment container, and can be applied to other types of liquid storing containers that stores liquid other than ink.

What is claimed is:

1. An ink supplying container for supplying ink to an ink tank of a printer through an ink inlet channel member protruding from the ink tank and including an ink inlet channel, the ink supplying container comprising:

a container body that contains the ink; and an ink outlet formation portion that is mounted on a leading end side of the container body, and forms an ink outlet, wherein the ink outlet formation portion includes:

a tubular channel portion that forms a supplying channel into which the ink inlet channel member is inserted; and an outlet valve unit that is accommodated in the tubular channel portion, the outlet valve unit is configured such that, (i) in a non-supplying state where the ink inlet channel member is not inserted into the tubular channel portion, the ink outlet is sealed, and (ii) in a supplying state where the ink inlet channel member is inserted from the ink outlet into the tubular channel portion, the supplying channel is in communication with the ink inlet channel, in the tubular channel portion, wherein the outlet valve unit includes a moving sealing member that includes a projection and an annular abutting portion on a leading end side of the moving sealing member, a first portion of the projection protrudes beyond the annular abutting portion in a direction away from a rear end side of the moving sealing member, and the annular abutting portion surrounds a second portion of the projection.

2. The ink supplying container according to claim 1, wherein the outlet valve unit includes:

a spring member that is accommodated in the tubular channel portion, and an outlet sealing member that is fixed to the ink outlet on the leading end side of the moving sealing member, and has an opening through which the ink inlet channel member passes, wherein the moving sealing member is accommodated on a leading end side of the spring member so as to be movable and is biased by the spring member toward a leading end of the ink supplying container, and the outlet valve unit is configured such that, (i) in the non-supplying state, the moving sealing member is biased toward the leading end of the ink supplying container by the spring member, and seals the opening of the outlet sealing member, and (ii) in the supplying state, the moving sealing member is pressed by the ink inlet channel member, and recedes toward the container body, and the supplying channel is in communication with the ink inlet channel, in the tubular channel portion.

3. The ink supplying container according to claim 2, wherein the outlet valve unit is configured such that, in the supplying state, a gap is formed in the tubular channel portion between the moving sealing member and the ink inlet channel member due to the projection of the moving sealing member abutting against the ink inlet channel member, and the supplying channel is in communication with the ink inlet channel via the gap.

4. The ink supplying container according to claim 3, wherein the ink inlet channel member includes a partitioning wall that partitions the ink inlet channel into a plurality of ink inlet channels, the projection of the moving sealing member is included at a position opposing the partitioning wall of the ink inlet channel member, the supplying channel of the tubular channel portion includes a plurality of supplying channels, and the outlet valve unit is configured such that, in the supplying state, the projection of the moving sealing member abuts against the partitioning wall of the ink inlet channel member, one or more of the plurality of supplying channels are in communication with one or more of the plurality of ink inlet channels, and one or more other supplying channels from among the plurality of supplying channels are in communication with one or more other ink inlet channels from among the plurality of ink inlet channels.

5. The ink supplying container according to claim 2, wherein the ink inlet channel member includes a partitioning wall that partitions the ink inlet channel into a plurality of ink inlet channels, openings of the plurality of ink inlet channels are included on a rear end side relative to a leading end of the partitioning wall, the supplying channel of the tubular channel portion includes a plurality of supplying channels, and the outlet valve unit is configured such that, in the supplying state, a leading end of the moving sealing member abuts against the leading end of the partitioning wall of the ink inlet channel member, one or more of the plurality of supplying channels are in communication with one or more of the plurality of ink inlet channels, and one or more other supplying channels from among the plurality of supplying channels are in communication with one or more other ink inlet channels from among the plurality of ink inlet channels.

6. The ink supplying container according to claim 5, wherein a leading end portion of the ink inlet channel member includes an inclined face in which the openings of the plurality of ink inlet channels are included, and the outlet valve unit is configured such that, in the supplying state, a gap is formed between the leading end of the moving sealing member and the inclined face of the ink inlet channel member, one or more of the plurality of supplying channels are in communication with one or more of the plurality of ink inlet channels through the gap, and one or more other supplying channels from among the plurality of supplying channels are in communication with one or more other ink inlet channels from among the plurality of ink inlet channels.

7. The ink supplying container according to claim 5, wherein the leading end portion of the ink inlet channel member includes an outer peripheral surface on which the openings of the plurality of ink inlet channels are formed, and the outlet valve unit is configured such that, in the supplying state, openings of one or more of the plurality of ink inlet channels are in communication with one or more of the plurality of supplying channels, in the tubular channel portion, and openings of one or more other ink inlet channels from among the plurality of ink inlet channels are in communication with one or more other supplying channels from among the plurality of supplying channels, in the tubular channel portion.

8. The ink supplying container according to claim 2, wherein the outlet sealing member is formed of a rubber member that deforms so as to contact with the outer peripheral surface of the ink inlet channel member, and seals the outer peripheral surface of the ink inlet channel member, in the supplying state.

* * * * *